US007022201B2

(12) United States Patent
Anderson et al.

(10) Patent No.: US 7,022,201 B2
(45) **Date of Patent: *Apr. 4, 2006**

(54) ENTANGLED FABRIC WIPERS FOR OIL AND GREASE ABSORBENCY

(75) Inventors: Ralph Lee Anderson, Marietta, GA (US); Eugenio Go Varona, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 120 days.

This patent is subject to a terminal disclaimer.

(21) Appl. No.: 10/328,450

(22) Filed: Dec. 23, 2002

(65) Prior Publication Data

US 2004/0121693 A1 Jun. 24, 2004

(51) Int. Cl.

| | |
|---|---|
| ***B31F 1/12*** | (2006.01) |
| ***D04H 1/06*** | (2006.01) |
| ***D04H 11/08*** | (2006.01) |

(52) U.S. Cl. ..... 156/183; 156/229; 162/111; 162/113; 264/282; 442/384; 28/103

(58) Field of Classification Search ..... 156/183, 156/229; 162/111, 112, 113; 264/280, 284, 264/282; 442/401, 408, 382, 384; 28/103, 28/104, 107, 112, 155

See application file for complete search history.

(56) References Cited

U.S. PATENT DOCUMENTS

| | | | |
|---|---|---|---|
| 1,301,605 | A | 4/1919 | Ringel |
| 2,014,460 | A | 9/1935 | Alm |
| 2,069,778 | A | 2/1937 | Rowe |
| 2,666,369 | A | 1/1954 | Niks |
| 3,338,992 | A | 8/1967 | Kinney |
| 3,341,394 | A | 9/1967 | Kinney |
| 3,485,706 | A | 12/1969 | Evans |
| 3,494,821 | A | 2/1970 | Evans |
| 3,502,538 | A | 3/1970 | Petersen |
| 3,502,763 | A | 3/1970 | Hartmann |

(Continued)

FOREIGN PATENT DOCUMENTS

| | | |
|---|---|---|
| CA | 2165107 | 6/1996 |
| EP | 0 097 036 | 12/1983 |
| EP | 0171806 A2 | 2/1986 |
| EP | 0624676 B1 | 11/1994 |
| EP | 0669994 B1 | 9/1995 |
| EP | 0685586 A2 | 12/1995 |
| EP | 0719355 B1 | 7/1996 |
| EP | 0765959 B1 | 4/1997 |
| EP | 0872206 | 10/1998 |
| EP | 0949371 A2 | 10/1999 |

(Continued)

OTHER PUBLICATIONS

Abstract of Japanese Patent No. 10072753, Mar. 17, 1998.
Abstract of Japanese Patent No. 11323715, Nov. 26, 1999.
Abstract of Japanese Patent No. 2182962, Jul. 17, 1990.
Abstract of Japanese Patent No. 4034058, Feb. 5, 1992.
Abstract of Japanese Patent No. 4057950, Feb. 25, 1992.

(Continued)

*Primary Examiner*—Sue A. Purvis
(74) *Attorney, Agent, or Firm*—Steven D. Flack; Richard M. Shane

(57) ABSTRACT

A composite fabric comprising a necked and creped spunbond nonwoven web of monocomponent fibers hydraulically entangled with a fibrous component that comprises cellulosic fibers. The nonwoven web contains thermoplastic fibers and the fibrous component comprises greater than about 50% by weight of the fabric.

9 Claims, 3 Drawing Sheets

U.S. PATENT DOCUMENTS

| | | | |
|---|---|---|---|
| 3,542,615 | A | 11/1970 | Dobo et al. |
| 3,597,299 | A | 8/1971 | Thomas et al. |
| 3,692,618 | A | 9/1972 | Dorschner et al. |
| 3,775,231 | A | 11/1973 | Thomas |
| 3,802,817 | A | 4/1974 | Matsuki et al. |
| 3,821,068 | A | 6/1974 | Shaw |
| 3,844,869 | A | 10/1974 | Rust, Jr. |
| 3,849,241 | A | 11/1974 | Butin et al. |
| 3,855,046 | A | 12/1974 | Hansen et al. |
| 3,879,257 | A | 4/1975 | Gentile et al. |
| 3,914,365 | A | 10/1975 | Kim et al. |
| 3,939,033 | A | 2/1976 | Grgach et al. |
| 3,949,128 | A | 4/1976 | Ostermeier |
| 3,953,638 | A | 4/1976 | Kemp |
| 4,100,324 | A | 7/1978 | Anderson et al. |
| 4,107,374 | A | 8/1978 | Kusunose et al. |
| 4,144,370 | A | 3/1979 | Boulton |
| 4,145,468 | A | 3/1979 | Mizoguchi et al. |
| 4,165,556 | A | 8/1979 | Nishida et al. |
| 4,239,720 | A | 12/1980 | Gerlach et al. |
| 4,259,399 | A | 3/1981 | Hill |
| 4,307,143 | A | 12/1981 | Meitner |
| 4,340,563 | A | 7/1982 | Appel et al. |
| 4,365,466 | A | 12/1982 | Horiuchi et al. |
| 4,369,156 | A | 1/1983 | Mathes et al. |
| 4,374,888 | A | 2/1983 | Bornslaeger |
| 4,460,699 | A | 7/1984 | Convers et al. |
| 4,476,186 | A | 10/1984 | Kato et al. |
| RE31,885 | E | 5/1985 | Meitner |
| 4,519,804 | A | 5/1985 | Kato et al. |
| 4,587,154 | A | 5/1986 | Hotchkiss et al. |
| 4,612,228 | A | 9/1986 | Kato et al. |
| 4,735,849 | A | 4/1988 | Murakami et al. |
| 4,774,110 | A | 9/1988 | Murakami et al. |
| 4,795,122 | A | 1/1989 | Petre |
| 4,795,668 | A | 1/1989 | Krueger et al. |
| 4,808,467 | A | 2/1989 | Suskind et al. |
| 4,833,012 | A | 5/1989 | Makimura et al. |
| 4,879,170 | A | 11/1989 | Radwanski et al. |
| 4,931,355 | A | 6/1990 | Radwanski et al. |
| 4,965,122 | A | 10/1990 | Morman |
| 4,981,747 | A | 1/1991 | Morman |
| 5,026,587 | A | 6/1991 | Austin et al. |
| 5,057,368 | A | 10/1991 | Largman et al. |
| 5,069,970 | A | 12/1991 | Largman et al. |
| 5,096,532 | A | 3/1992 | Neuwirth et al. |
| 5,108,820 | A | 4/1992 | Kaneko et al. |
| 5,110,403 | A | 5/1992 | Ehlert |
| 5,136,761 | A | 8/1992 | Sternlieb et al. |
| 5,137,600 | A | 8/1992 | Barnes et al. |
| 5,162,074 | A | 11/1992 | Hills |
| 5,204,703 | A | 4/1993 | Hutchinson et al. |
| 5,219,633 | A | 6/1993 | Sabee |
| 5,223,319 | A | 6/1993 | Cotton et al. |
| 5,226,992 | A | 7/1993 | Morman |
| 5,254,399 | A | 10/1993 | Oku et al. |
| 5,258,220 | A | 11/1993 | Joseph |
| 5,277,976 | A | 1/1994 | Hogle et al. |
| 5,281,463 | A | 1/1994 | Cotton |
| 5,284,703 | A | 2/1994 | Everhart et al. |
| 5,290,628 | A | 3/1994 | Lim et al. |
| 5,336,545 | A | 8/1994 | Morman |
| 5,336,552 | A | 8/1994 | Strack et al. |
| 5,350,624 | A | 9/1994 | Georger et al. |
| 5,355,565 | A | 10/1994 | Baravian |
| 5,364,680 | A | 11/1994 | Cotton |
| 5,366,793 | A | 11/1994 | Fitts, Jr. et al. |
| 5,382,400 | A | 1/1995 | Pike et al. |
| 5,389,202 | A | 2/1995 | Everhart et al. |
| 5,393,599 | A | 2/1995 | Quantrille et al. |
| 5,413,811 | A | 5/1995 | Fitting et al. |
| 5,466,410 | A | 11/1995 | Hills |
| 5,498,232 | A | 3/1996 | Scholz |
| 5,509,430 | A | 4/1996 | Berger |
| D369,907 | S | 5/1996 | Sayovitz et al. |
| 5,534,340 | A | 7/1996 | Gupta et al. |
| 5,573,719 | A | 11/1996 | Fitting |
| 5,573,841 | A | 11/1996 | Adam et al. |
| 5,575,874 | A | 11/1996 | Griesbach, III et al. |
| 5,587,225 | A | 12/1996 | Griesbach et al. |
| 5,607,798 | A | 3/1997 | Kobylivker et al. |
| 5,614,281 | A | 3/1997 | Jackson et al. |
| 5,620,779 | A | 4/1997 | Levy et al. |
| 5,635,290 | A | 6/1997 | Stopper et al. |
| 5,643,240 | A | 7/1997 | Jackson et al. |
| 5,647,883 | A | 7/1997 | Houpt et al. |
| 5,652,051 | A | 7/1997 | Shawver et al. |
| 5,704,101 | A | 1/1998 | Majors et al. |
| 5,707,468 | A | 1/1998 | Arnold et al. |
| D390,708 | S | 2/1998 | Brown |
| 5,718,972 | A | 2/1998 | Murase et al. |
| 5,719,219 | A | 2/1998 | Shah et al. |
| 5,733,635 | A | 3/1998 | Terakawa et al. |
| 5,759,926 | A | 6/1998 | Pike et al. |
| 5,770,309 | A | 6/1998 | Houpt et al. |
| 5,780,369 | A | 7/1998 | Allison et al. |
| 5,783,503 | A | 7/1998 | Gillespie et al. |
| 5,785,179 | A | 7/1998 | Buczwinski et al. |
| 5,801,107 | A | 9/1998 | Everhart et al. |
| 5,810,954 | A | 9/1998 | Jacobs et al. |
| 5,814,390 | A | 9/1998 | Stokes et al. |
| 5,817,199 | A | 10/1998 | Brennecke et al. |
| 5,840,633 | A | 11/1998 | Kurihara et al. |
| 5,853,635 | A | 12/1998 | Morell et al. |
| 5,853,859 | A | 12/1998 | Levy et al. |
| 5,858,504 | A | 1/1999 | Fitting |
| 5,858,515 | A | 1/1999 | Stokes et al. |
| 5,885,909 | A | 3/1999 | Rudisill et al. |
| 5,895,710 | A | 4/1999 | Sasse et al. |
| 5,914,084 | A | 6/1999 | Benson et al. |
| 5,935,512 | A | 8/1999 | Haynes et al. |
| 5,935,883 | A | 8/1999 | Pike |
| 5,962,112 | A | 10/1999 | Haynes et al. |
| 5,964,351 | A | 10/1999 | Zander |
| 5,965,084 | A | 10/1999 | Nishijima |
| 5,968,855 | A | 10/1999 | Perdelwitz, Jr. et al. |
| 5,979,030 | A | 11/1999 | Legare |
| 5,993,944 | A | 11/1999 | Honna et al. |
| 6,004,673 | A | 12/1999 | Nishijima |
| 6,022,818 | A | 2/2000 | Welchel et al. |
| 6,030,331 | A | 2/2000 | Zander |
| 6,063,717 | A | 5/2000 | Ishiyama et al. |
| 6,069,097 | A | 5/2000 | Suzuki et al. |
| 6,080,466 | A | 6/2000 | Yoshimura et al. |
| D428,267 | S | 7/2000 | Romano, III et al. |
| 6,093,665 | A | 7/2000 | Sayovitz et al. |
| D428,710 | S | 8/2000 | Romano, III et al. |
| 6,103,061 | A | 8/2000 | Anderson et al. |
| 6,107,268 | A | 8/2000 | Yahiaoui et al. |
| 6,110,848 | A | 8/2000 | Bouchette |
| 6,114,263 | A | 9/2000 | Benson et al. |
| 6,136,775 | A | 10/2000 | Strout et al. |
| 6,150,002 | A * | 11/2000 | Varona ..... 428/99 |
| 6,158,614 | A | 12/2000 | Haines et al. |
| 6,187,699 | B1 | 2/2001 | Terakawa et al. |
| 6,197,404 | B1 | 3/2001 | Varona |
| 6,200,669 | B1 | 3/2001 | Marmon et al. |
| 6,258,196 | B1 | 7/2001 | Suzuki et al. |
| 6,264,776 | B1 | 7/2001 | DiPalma |
| 6,269,969 | B1 | 8/2001 | Huang et al. |
| 6,269,970 | B1 | 8/2001 | Huang et al. |

| | | | |
|---|---|---|---|
| 6,273,359 | B1 | 8/2001 | Newman et al. |
| 6,314,627 | B1 | 11/2001 | Ngai |
| 6,315,864 | B1 | 11/2001 | Anderson et al. |
| 6,325,864 | B1 | 12/2001 | Zahuranec et al. |
| 6,375,889 | B1 | 4/2002 | Holmes et al. |
| 6,381,817 | B1 | 5/2002 | Moody, III |
| 6,460,233 | B1 | 10/2002 | Noelle |
| 6,461,729 | B1 | 10/2002 | Dugan |
| 6,723,669 | B1 | 4/2004 | Clark et al. |
| 6,797,226 | B1 | 9/2004 | Annable |
| 2001/0008180 | A1 | 7/2001 | Anderson et al. |
| 2001/0037850 | A1 | 11/2001 | Marmon et al. |
| 2002/0006502 | A1 | 1/2002 | Nagoka et al. |
| 2002/0015069 | A1 | 2/2002 | Yamamoto et al. |
| 2002/0034907 | A1 | 3/2002 | Groitzsch et al. |
| 2002/0099347 | A1 | 7/2002 | Chen et al. |
| 2002/0110655 | A1 | 8/2002 | Seth |
| 2002/0132545 | A1 | 9/2002 | Lenz |
| 2003/0003832 | A1 | 1/2003 | Childs et al. |
| 2003/0118776 | A1 | 6/2003 | Anderson et al. |
| 2003/0131919 | A1 | 7/2003 | King et al. |
| 2003/0194932 | A1 | 10/2003 | Clark et al. |
| 2003/0207636 | A1 | 11/2003 | Gosavi et al. |
| 2004/0121121 | A1 | 6/2004 | Anderson et al. |
| 2004/0121689 | A1 | 6/2004 | Anderson et al. |

FOREIGN PATENT DOCUMENTS

| | | | |
|---|---|---|---|
| EP | 0963745 | B1 | 12/1999 |
| EP | 0992338 | | 4/2000 |
| EP | 1050612 | | 11/2000 |
| EP | 0 796 940 | | 2/2003 |
| GB | 935124 | | 8/1963 |
| JP | 05214654 | | 8/1993 |
| WO | WO 9612615 | | 5/1996 |
| WO | WO 9719808 | A1 | 6/1997 |
| WO | WO 9809010 | A1 | 3/1998 |
| WO | WO 9920821 | | 4/1999 |
| WO | WO 9920822 | A1 | 4/1999 |
| WO | WO 0008245 | | 2/2000 |
| WO | WO 01/41622 | | 6/2001 |
| WO | WO 01/88247 | | 11/2001 |
| WO | WO 02/34511 | | 5/2002 |
| WO | WO 02/38846 | | 5/2002 |
| WO | WO 02/064360 | | 8/2002 |
| WO | WO 02/064871 | | 8/2002 |
| WO | WO 02/076723 | | 10/2002 |

OTHER PUBLICATIONS

Abstract of Japanese Patent No. 4257359, Sep. 11, 1992.
Abstract of Japanese Patent No. 4272219, Sep. 29, 1992.
Abstract of Japanese Patent No. 48033174, May 8, 1973.
Abstract of Japanese Patent No. 5179545, Jul. 20, 1993.
Abstract of Japanese Patent No. 5214653, Aug. 24, 1993.
Abstract of Japanese Patent No. 5287660, Nov. 2, 1993.
Abstract of Japanase Patent No. 5321018, Dec. 7, 1993.
Abstract of Japanese Patent No. 6184823, Jul. 5, 1994.
Abstract of Japanese Patent No. 6207361, Jul. 26, 1994.
Abstract of Japanese Patent No. 62268861, Nov. 21, 1987.
Abstract of Japanese Patent No. 6264345, Sep. 20, 1994.
Abstract of Japanese Patent No. 6306754, Nov. 1, 1994.
Abstract of Japanese Patent No. 6313215, Nov. 8, 1994.
Abstract of Japanese Patent No. 6330447, Nov. 29, 1994.
Abstract of Japanese Patent No. 8260247, Oct. 8, 1996.
Abstract of Japanese Patent No. 8311717, Nov. 26, 1996.
Abstract of Japanese Patent No. 8311718, Nov. 26, 1996.
"Polyamide Resins" by Don E. Floyd, Library of Congress Catalog No. 66–20811, Reinhold Publishing, NY 1966.
Kimberly–Clark Professional WYPALL®X Wipers, 2 pgs., Mar. 6, 2003.
Abstract of Japanese Patent No. 1026706, Jan. 30, 1989.

* cited by examiner

ENTANGLED FABRIC WIPERS FOR OIL AND GREASE ABSORBENCY

FIELD OF THE INVENTION

The invention pertains to wipers. More specifically, the invention pertains to wipers which absorb oil and grease and methods of making the same.

BACKGROUND OF THE INVENTION

Wipers have been created to satisfy both the needs of commercial (industrial) or individual consumer (domestic) applications. Domestic and industrial wipers are often used to quickly absorb both polar liquids (e.g., water and alcohols) and nonpolar liquids (e.g., oil). The wipers must have a sufficient absorption capacity to hold the liquid within the wiper structure until it is desired to remove the liquid by pressure, e.g., wringing. In addition, the wipers must also possess good physical strength and abrasion resistance to withstand the tearing, stretching and abrading forces often applied during use. Moreover, the wipers should also be soft to the touch. In particular, industrial wipers which are regularly used to clean oil, grease and grime, are often squeezed into narrow crevices of machinery. Therefore, such wipers should be easily conformable in and around small openings.

In the past, nonwoven fabrics which are typically hydrophobic, such as meltblown nonwoven webs, have been widely used as wipers. Meltblown nonwoven webs possess an interfiber capillary structure that is suitable for absorbing and retaining liquid. However, meltblown nonwoven fibrous webs sometimes lack the requisite physical properties for use as a heavy-duty wiper, e.g., tear strength and abrasion resistance. Consequently, meltblown nonwoven webs are typically laminated to a support layer, e.g., a spunbond nonwoven web, which may not be desirable for use on abrasive or rough surfaces.

Spunbond and staple fiber nonwoven webs, which contain thicker and stronger fibers than meltblown nonwoven webs and typically are point bonded with heat and pressure, can provide good physical properties, including tear strength and abrasion resistance. However, spunbond and staple fiber nonwoven webs sometimes lack fine interfiber capillary structures that enhance the adsorption characteristics of the wiper. Furthermore, spunbond and staple fiber nonwoven webs often contain bond points that may inhibit the flow or transfer of liquid within the nonwoven webs. As such, a need remains for a fabric that exhibits the requisite strength and good oil and grease absorption properties for use in a wide variety of wiper applications.

Further, since certain nonwoven manufacturing processes often lead to the production of fairly rigid nonwoven materials, there is a need for wipers which are softer and more gentle to the touch, and further that are conformable so as to allow such wipers to be used in small openings and around a variety of shaped objects and inside crevices, where oil and grease may accumulate. It is to such needs that the current invention is directed.

SUMMARY OF THE INVENTION

In accordance with one aspect of the present invention, a method is disclosed for forming a fabric. The method includes forming a nonwoven web that defines a first surface and a second surface. The nonwoven web comprises monocomponent fibers. The monocomponent fibers can be formed from a variety of polymeric materials and desirably using a spunbonding process. For instance, in some embodiments, the monocomponent fibers comprise polyolefins such as polyethylene or polypropylene or alternatively polyester, nylon, rayon, and combinations thereof.

The monocomponent fibrous web is then stretched in a certain direction. For example, in one embodiment, the nonwoven web is mechanically stretched in the machine direction, that is the direction of web manufacture. As a result, the web can become "necked" thereby increasing the stretch of the web in the cross machine direction. The nonwoven web can generally be stretched to any extent desired. For example, in some embodiments, the nonwoven web is stretched by about 10% to about 100% of its initial length, and in some embodiments, by about 25% to about 75% of its initial length.

Once the nonwoven web is formed and stretched in the machine direction, a first surface of the web is adhered to a first creping surface from which the web is then creped. In one embodiment, for example, a creping adhesive is applied to the first surface of the nonwoven web in a spaced-apart pattern such that the first surface of the nonwoven web is adhered to the creping surface according to such spaced-apart pattern. Moreover, in some embodiments, the second surface of the nonwoven web can also be adhered to a second creping surface from which the web is then creped. Although not required, creping two surfaces of the web can sometimes enhance certain characteristics of the resulting fabric.

The stretched and creped monocomponent fibrous web is then entangled (e.g., hydraulic, air, mechanical, etc.) with another fibrous material layer component. For instance, the stretched, creped nonwoven web is then hydraulically entangled with another fibrous material layer component. If desired, the stretched, creped nonwoven web can be entangled with a fibrous material layer component that includes cellulosic fibers. Besides cellulosic fibers, the fibrous material may further comprise other types of fibers, such as synthetic staple fibers. In some embodiments when utilized, the synthetic staple fibers can comprise between about 10% to about 20% by weight of the fibrous material layer and have an average fiber diameter of between about ¼ inches to about ⅜ inches. In some embodiments, the fibrous material component layer comprises greater than about 50% by weight of the fabric, and in some embodiments, from about 60% to about 90% by weight of the fabric. In a further alternative embodiment, the entangled fabric is also post processed in some fashion. Other features and aspects of the present invention are discussed in greater detail below.

Figure 1:
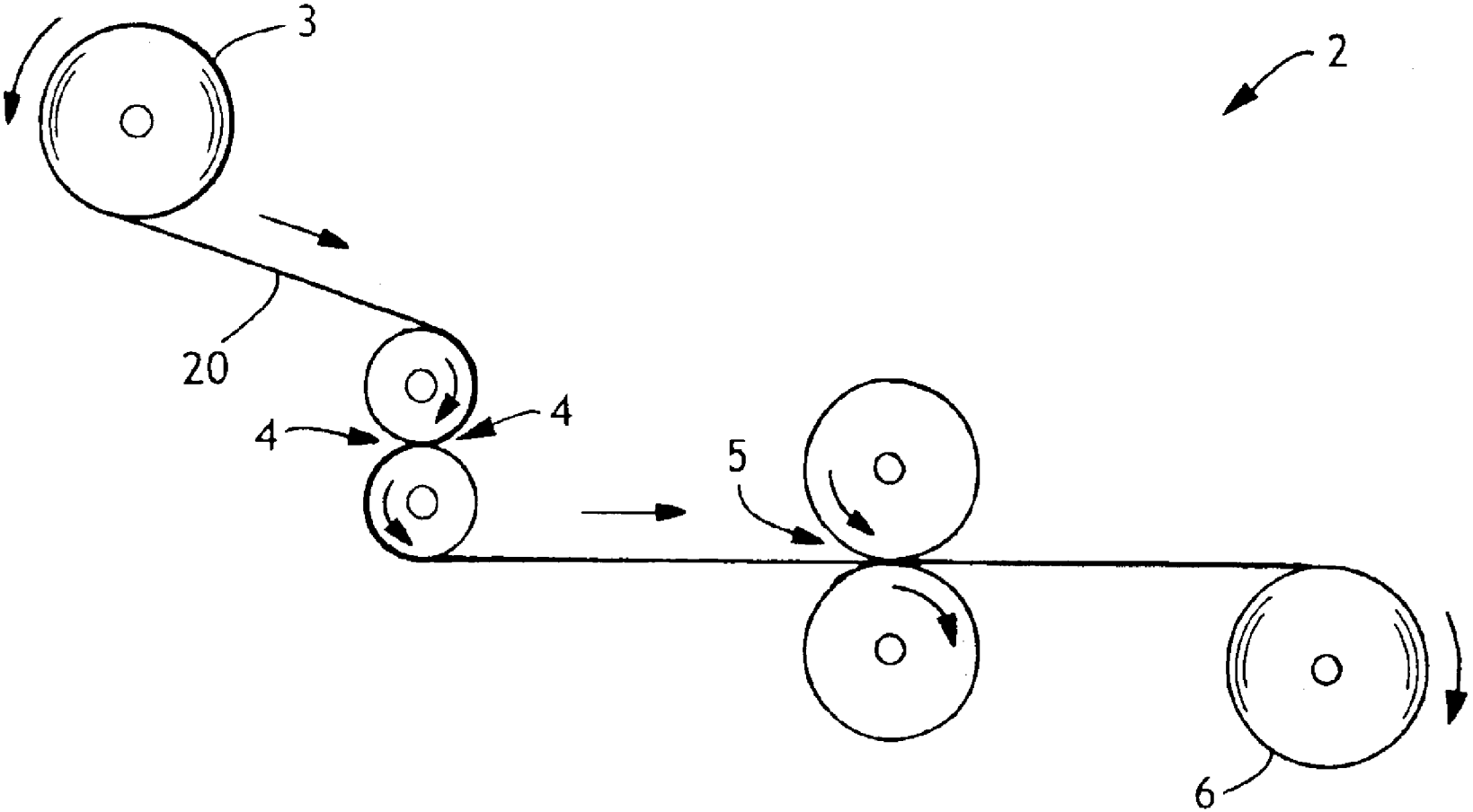
FIG. 1 is a schematic illustration of a process for necking a nonwoven substrate in accordance with one embodiment of the present invention.

Repeat use of reference characters in the present specification and drawings is intended to represent the same or analogous features or elements of the invention.

DETAILED DESCRIPTION

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

DEFINITIONS

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, bonded carded web processes, etc.

As used herein, the term "carded web" refers to a web that is made from staple fibers sent through a combing or carding unit, which separates or breaks apart and aligns the fibers to form a nonwoven web.

As used herein, the term "monocomponent fibers" refers to fibers that have been formed from primarily a single polymer component, such that the single polymeric component occupies a single continuous phase of the fibers. The fibers may also include fillers and other processing aids in a discontinuous phase. Such fillers and processing aids do not significantly affect the desired characteristics of a given composition of the fibers. Exemplary fillers and processing aids of this sort include, without limitation, pigments, antioxidants, stabilizers, surfactants, waxes, flow promoters, solvents, particulates, and other materials added to enhance the processability of the fiber composition. Such fillers and/or processing aids are not present in any ordered formation, such as would be the case in the symmetric configurations that are typical of multicomponent/conjugate fibers where polymers are consistently present along the length of a fiber in a constant location or distinct zone. Webs made of monocomponent fibers may include various fibers, each of different polymers. That is, a variety of monocomponent polymer fibers may be utilized to form the overall web.

The individual components in conjugate fibers are typically arranged in substantially constantly positioned distinct zones across the cross-section of the fiber and extend substantially along the entire length of the fiber. The configuration of such conjugate fibers may be, for example, a side-by-side arrangement, a pie arrangement, or any other arrangement. Bicomponent fibers and methods of making the same are taught in U.S. Pat. No. 5,108,820 to Kaneko, et al., U.S. Pat. No. 4,795,668 to Kruege, et al., U.S. Pat. No. 5,382,400 to Pike, et al., U.S. Pat. No. 5,336,552 to Strack, et al., U.S. Pat. No. 6,200,669 to Marmon, et al., U.S. Pat. No. 5,277,976 to Hogle, et al., U.S. Pat. No. 5,162,074 to Hills, U.S. Pat. No. 5,466,410 to Hills, U.S. Pat. No. 5,069,970 to Largman, et al., and U.S. Pat. No. 5,057,368 to Largman, et al.

As used herein, the term "average pulp fiber length" refers to a weighted average length of pulp fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i}^{k} (x_i^* n_i)/n$$

wherein, k=maximum fiber length $x_i$=fiber length $n_i$=number of fibers having length $x_i$; and n=total number of fibers measured.

As used herein, the term "low-average fiber length pulp" refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.7 to 1.2 mm. Exemplary low average fiber length pulps include virgin hardwood pulp, and secondary fiber pulp from sources such as, for example, office waste, newsprint, and paperboard scrap.

As used herein, the term "high-average fiber length pulp" refers to pulp that contains a relatively small amount of short fibers and non-fiber particles. High-average fiber length pulp is typically formed from certain non-secondary (i.e., virgin) fibers. Secondary fiber pulp that has been screened may also have a high-average fiber length. High-average fiber length pulps typically have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps that are wood fiber pulps include, for example, bleached and unbleached virgin softwood fiber pulps.

As used herein, the term "thermal point bonding" refers to a bonding process that results in the formation of small, discrete bond points. For example, thermal point bonding may involve passing a fabric or web of fibers to be bonded between a heated calender roll and an anvil roll. The calender roll is usually, though not always, patterned in some way so that the entire fabric is not bonded across its entire surface, and the anvil roll is usually flat. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings, incorporated herein by reference in its entirety. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%.

Another typical point bonding pattern is the expanded Hansen Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds with about a 16% bond area and a wire weave pattern looking as the name suggests, e.g. like a window screen, with about a 19% bond area. Typically, the percent bonding area varies from around 10% to around 30% of the area of the fabric laminate web. As is well known in the art, the spot bonding holds the laminate layers together as well as imparts integrity to each individual layer by bonding filaments and/or fibers within each layer.

As used herein, the term "spunbond web" refers to a nonwoven web formed from small diameter substantially continuous fibers. The fibers are formed by extruding a molten thermoplastic material as filaments from a plurality of fine, usually circular, capillaries of a spinnerette with the diameter of the extruded fibers then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond fibers are generally not tacky when they are deposited onto a collecting surface. Spunbond fibers can sometimes have diameters less than about 40 microns, and are often between about 5 to about 20 microns.

As used herein, the term "meltblown web" refers to a nonwoven web formed from fibers extruded through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin, et al., which is incorporated herein in its entirety by reference thereto for all purposes. In some instances, meltblown fibers may be microfibers that may be continuous or discontinuous, are generally smaller than 10 microns in diameter, and are generally tacky when deposited onto a collecting surface.

As used herein, the term "pulp" refers to fibers from natural sources such as woody and non-woody plants. Woody plants include, for example, deciduous and coniferous trees. Non-woody plants include, for example, cotton, flax, esparto grass, milkweed, straw, jute hemp, and bagasse.

As used herein and in the claims, the term "comprising" is inclusive or open-ended and does not exclude additional unrecited elements, compositional components, or method steps.

"Polymers" include, but are not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

"Thermoplastic" describes a material that softens when exposed to heat and which substantially returns to a non-softened condition when cooled to room temperature.

As used herein, the terms "pattern unbonded" or interchangeably "point unbonded" or "PUB", refer to a bonding process that results in the formation of a pattern having continuous bonded areas defining a plurality of discrete unbonded areas. One suitable process for forming the pattern-unbonded nonwoven material includes providing a nonwoven fabric or web, providing opposedly positioned first and second calender rolls, and defining a nip therebetween, with at least one of the rolls being heated and having a bonding pattern on its outermost surface including a continuous pattern of land areas defining a plurality of discrete openings, apertures or holes, and passing the nonwoven fabric or web within the nip formed by the rolls. Each of the openings in the roll or rolls defined by the continuous land areas forms a discrete unbonded area in at least one surface of the nonwoven fabric or web in which the fibers or filaments of the web are substantially or completely unbonded. Stated alternatively, the continuous pattern of land areas in the roll or rolls forms a continuous pattern of bonded areas that define a plurality of discrete unbonded areas on at least one surface of the nonwoven fabric or web. The pattern-unbonded process is described in U.S. Pat. No. 5,858,515 to Stokes which is incorporated by reference herein in its entirety.

As used herein, the term "machine direction" or "MD" means the lengthwise direction of a fabric in the direction in which it is produced. The term "cross direction" or "cross machine direction" or "CD" means the crosswise direction of fabric, i.e. a direction generally perpendicular to the MD.

As used herein, the term "basis weight" or "BW" equals the weight of a sample divided by the area measured in either ounces per square yard or grams per square meter. (either osy or $g/m^2$) and the fiber diameters useful are usually expressed in microns. (Note that to convert from osy to gsm, multiply osy by 33.91).

As used herein, the term "neckable material or layer" means any material which can be necked such as a nonwoven, woven, or knitted material. As used herein, the term "necked material" refers to any material which has been extended in at least one dimension, (e.g. lengthwise), reducing the transverse dimension, (e.g. width), such that when the extending force is removed, the material can be pulled back, or relax, to its original width. The necked material typically has a higher basis weight per unit area than the un-necked material. When the necked material returns to its original un-necked width, it should have about the same basis weight as the un-necked material. This differs from stretching/orienting a material layer, during which the layer is thinned and the basis weight is permanently reduced. See for instance U.S. Pat. No. 4,965,122 which is incorporated in its entirety by reference hereto.

Conventionally, "neck bonded" refers to either an elastic material being bonded to a neckable material while the neckable material is extended and necked, or alternatively, the neckable material being attached in some fashion to another nonwoven material, while the neckable material is extended and necked. "Neck bonded laminate" refers to a composite material having at least two layers in which one layer is a necked material that has been attached to another layer while the necked material is in a necked condition. Examples of neck-bonded laminates are such as those described in U.S. Pat. Nos. 5,226,992; 4,981,747; 4,965,122 and 5,336,545 to Morman, all of which are incorporated herein by reference in their entirety.

An improved wiper for absorbing oil and grease, and with increased softness and conformability is produced using a necked, creped nonwoven web in a hydroentangling process. Desirably, the wiper includes spunbond nonwoven materials, made from monocomponent fibers. The wiper, which is comprised of a pulp and the nonwoven material demonstrates enhanced oil and grease absorbency, capacity and bulk. In an alternative embodiment, the spunbond nonwoven materials may include greater than one type of monocomponent fibers. For instance, the spunbond nonwoven web may include two or more types of monocomponent fibers, in order to provide a variety of nonwoven material attributes.

The wiper is desirably at least about 50 percent pulp, such as northern softwood kraft pulp. Desirably, the oil permeability is at least 50 percent greater than the standard spunbond/pulp wiper of the same, or similar basis weight.

In general, the present invention is directed to an entangled fabric that contains a monocomponent nonwoven web that has been necked, creped, and then entangled with a fibrous component. In some embodiments, for example, the nonwoven web is hydraulically entangled with a fibrous material that includes cellulosic fibers and optionally synthetic staple fibers.

The nonwoven web used in the fabric of the present invention is desirably formed by spunbond processes and from a variety of different monocomponent materials. A wide variety of polymeric materials are known to be suitable for use in fabricating the spunbond fibers used in the present invention. Examples include, but are not limited to, polyolefins, polyesters, polyamides, as well as other melt-spinnable and/or fiber forming polymers. The polyamides that may be used in the practice of this invention may be any polyamide known to those skilled in the art including copolymers and mixtures thereof. Examples of polyamides and their methods of synthesis may be found in "Polymer Resins" by Don E. Floyd (Library of Congress Catalog number 66-20811, Reinhold Publishing, NY, 1966). Particularly commercially useful polyamides are nylon-6, nylon 66, nylon-11 and nylon-12. These polyamides are available from a number of sources, such as Emser Industries of Sumter, S.C. (Grilon® & Grilamide® nylons) and Atochem, Inc. Polymers Division, of Glen Rock, N.J. (Rilsan® nylons), among others.

Many polyolefins are available for fiber production, for example, polyethylenes such as Dow Chemical's ASPUN 6811A LLDPE (linear low density polyethylene), 2553 LLDPE and 25355 and 12350 high density polyethylene are such suitable polymers. Fiber forming polypropylenes include Exxon Chemical Company's Escorene® PD 3445 polypropylene and Himont Chemical Co.'s PF-304. Numerous other suitable fiber forming polyolefins, in addition to those listed above, are also commercially available. In addition, other fibers, such as synthetic cellulosic fibers (e.g., rayon or viscose rayon) may also be used to form the spunbond fibers. In a particular embodiment, the fibers may be nonelastomeric, that is demonstrating little if any stretch recovery on their own, upon removal of a biasing force.

In one particular embodiment of the present invention, the web is comprised of monocomponent polyolefinic spunbond fibers, and in particular polypropylene spunbond of about 0.8 osy basis weight and about 3 denier. The denier per filament of the fibers used to form the webs may vary. For instance, in one particular embodiment, the denier per filament of polyolefin fibers used to form the spunbond nonwoven web is less than about 3, and in another embodiment, from about 1 to about 3. Likewise, the basis weight of such a spunbond may vary. For instance, in one embodiment, the basis weight is between about 0.5 osy and 1.0 osy. In an alternative embodiment, the basis weight is between about 0.6 osy and 0.8 osy. The spunbond is typically produced using pattern bonding, such as using a wire weave pattern, having between about 14–25 percent bond area.

The spunbond fibers are produced using manufacturing techniques known to those skilled in the art. As previously indicated, the spunbond fibers used to form the nonwoven web may also be bonded to improve the durability, strength, hand, aesthetics and/or other properties of the web. For instance, the spun nonwoven web can be thermally, ultrasonically, adhesively, and/or mechanically bonded. As an example, the nonwoven web can be point or pattern bonded (thermal bond). An exemplary point bonding process is thermal point bonding, which generally involves passing one or more layers between heated rolls, such as an engraved patterned roll and a second bonding roll. The engraved roll is patterned in some way so that the web is not bonded over its entire surface, and the second roll can be smooth or patterned. As a result, various patterns for engraved rolls have been developed for functional as well as aesthetic reasons. Exemplary bond patterns include, but are not limited to, those described in U.S. Pat. No. 3,855,046 to Hansen, et al., U.S. Pat. No. 5,620,779 to Levy, et al., U.S. Pat. No. 5,962,112 to Haynes, et al., U.S. Pat. No. 6,093,665 to Sayovitz, et al., U.S. Des. Pat. No. 428,267 to Romano, et al. and U.S. Des. Pat. No. 390,708 to Brown, which are incorporated herein in their entirety by reference thereto for all purposes.

For instance, in some embodiments, the nonwoven web may be optionally bonded to have a total bond area of less than about 30% (as determined by conventional optical microscopic methods) and/or a uniform bond density greater than about 100 bonds per square inch. For example, the nonwoven web may have a total bond area from about 2% to about 30% and/or a bond density from about 250 to about 500 pin bonds per square inch. Such a combination of total bond area and/or bond density may, in some embodiments, be achieved by bonding the nonwoven web with a pin bond pattern having more than about 100 pin bonds per square inch that provides a total bond surface area less than about 30% when fully contacting a smooth anvil roll. In some embodiments, the bond pattern may have a pin bond density from about 250 to about 350 pin bonds per square inch and/or a total bond surface area from about 10% to about 25% when contacting a smooth anvil roll.

Further, the nonwoven web can be bonded by continuous seams or patterns (e.g., pattern unbonded). As additional examples, the nonwoven web can be bonded along the periphery of the sheet or simply across the width or cross-direction (CD) of the web adjacent the edges. Other bond techniques, such as a combination of thermal bonding and latex impregnation, may also be used. Alternatively and/or additionally, a resin, latex or adhesive may be applied to the nonwoven web by, for example, spraying or printing, and dried to provide the desired bonding. Still other suitable bonding techniques may be described in U.S. Pat. No. 5,284,703 to Everhart, et al., U.S. Pat. No. 6,103,061 to Anderson, et al., and U.S. Pat. No. 6,197,404 to Varona, which are incorporated herein in their entirety by reference thereto for all purposes.

After being produced (spun), the nonwoven web is then necked, that is, the nonwoven web is then stretched in the machine and/or cross machine direction. Stretching of the web is used to optimize and enhance physical properties in the fabric, including but not limited to softness and conformability. For example, in one embodiment, the web can be mechanically stretched in the machine direction to cause the web to contract or neck in the cross machine direction. The resulting necked web thus becomes more stretchable in the cross machine direction, when compared to the same unnecked material.

Mechanical stretching of the web can be accomplished using any of a variety of processes that are well known in the art. For instance, the web may be prestretched between 0 to about 100% of its initial length in the machine direction to obtain a necked web that can be stretched (e.g., by about 0 to more than 100%) in the cross machine direction. Typically the web is stretched by about 5% to about 100% of its initial length, alternatively between about 10% to about 100%, and more commonly by about 25% to about 75% of its initial length in the machine direction. In another alternative embodiment, the degree of stretch may be less than about 50%, in some embodiments between about 5 to 40%, and in further embodiments from about 10 to about 30%. Such web is typically stretched between at least two processing roll sets or roll nips where the second of the processing rolls or roll nips is operating at a faster speed than the first.

In particular, there is schematically illustrated in FIG. 1 a schematic exemplary process 2 for necking a neckable material utilizing an S-roll arrangement. Further description for the necking process may be found in U.S. Pat. No. 5,336,545, which is incorporated by reference hereto in its entirety. A neckable material (the spunbond web) 20 is unwound from a supply roll 3. The neckable material 20 then travels in the direction indicated by the arrow associated therewith as the supply roll rotates in the direction of the arrow associated therewith. The neckable material then passes through the nip 4 of an S-roll arrangement formed by a stack of rollers. Alternatively, the neckable material may be formed by known extrusion processes, such as for example, known spunbonding processes, and passed directly through the nip without first being stored on a supply roll.

The neckable material passes through the nip 4 of the S roll arrangement in a reverse S wrap path as indicated by the rotation direction arrows associated with the stack rollers. From the S-roll arrangement, the neckable material 20 passes through the nip of a drive roll arrangement 5, formed by drive rollers. Because the peripheral linear speed of the stack rollers of the S-roll arrangement is controlled to be lower than the peripheral linear speed of the drive roller arrangement, the neckable material is tensioned between the S-roll arrangement and the drive roller arrangement. Essentially, the web is passed between the counter-rotating roll sets without significant slippage. By adjusting the difference in speeds of the rollers, the neckable material 20 is tensioned so that it necks a desired amount and is maintained in such necked condition as it is wound up on wind-up roll 6.

Alternatively, a driven wind up roll (not shown) may be used so the neckable material may be stretched or drawn between the S-roll arrangement and the driven wind-up roll by controlling the peripheral linear speed of the stack rollers of the S-roll arrangement to be lower than the peripheral linear speed of the driven wind-up roll. In yet another embodiment, an unwind having a brake which can be set to provide a resistance may be used instead of an S roll arrangement. The degree of stretch may be calculated by dividing the difference in the stretched dimension, e.g., width, between the initial nonwoven web and the stretched nonwoven web, by the initial dimension of the nonwoven web.

As an example, the operational speed of the first stack rolls may be above about 175 feet per minute, desirably between about 200 and 250 feet per minute, and the operational speed of the second set of rollers may be above 300 feet per minute. Desirably, the first stack roll speed is between about 60 and 90 percent of the second stack roll speed. In this fashion, a web is produced which is necked in the cross machine direction, eventually allowing stretch elongation/extensibility in that direction.

Other stretching techniques can also be utilized in the present invention to apply stretching tension in the machine and/or cross-machine directions. For instance, an example of suitable stretching processes is a tenter frame process that utilizes a gripping device, e.g., clips, to hold the edges of the nonwoven web and apply the stretching force. Still other examples of stretching techniques that are believed to be suitable for use in the present invention are described in U.S. Pat. No. 5,573,719 to Fitting, which is incorporated herein in its entirety by reference thereto for all purposes.

Figure 2:
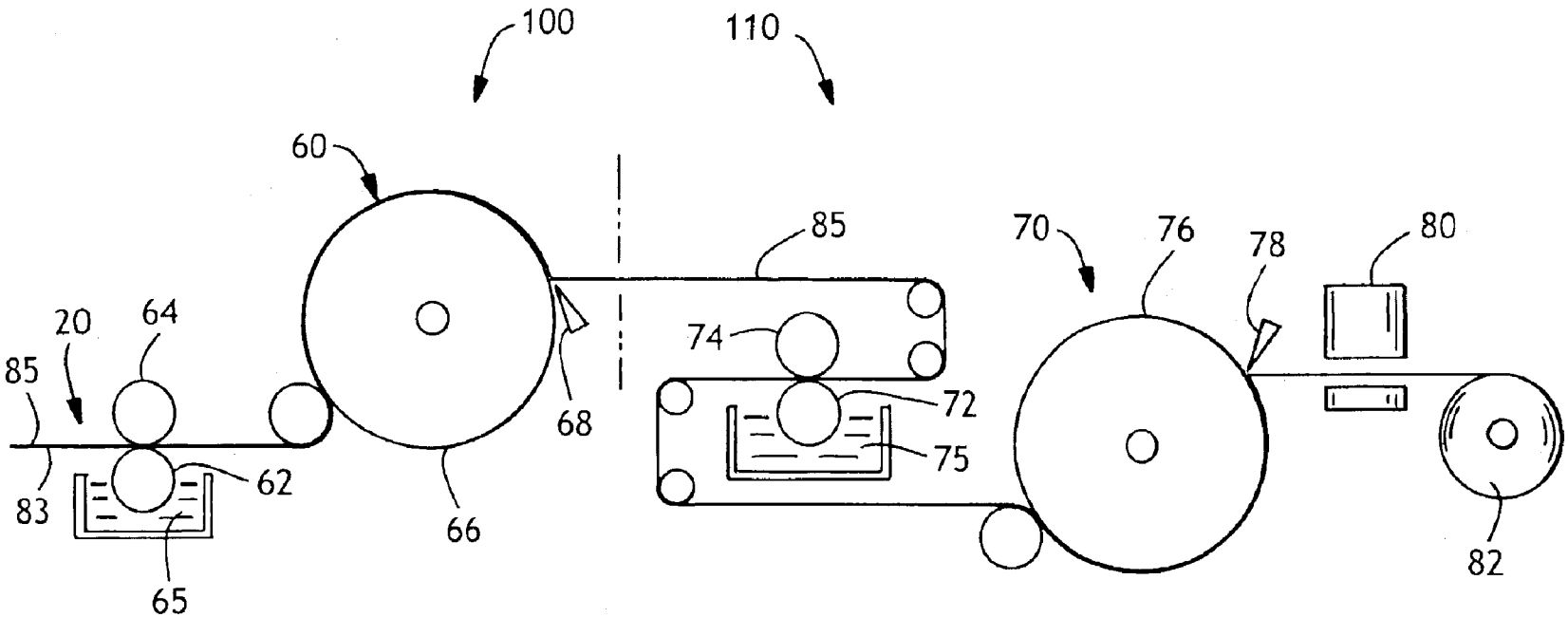
FIG. 2 is a schematic illustration of a process for creping a nonwoven substrate in accordance with one embodiment of the present invention.

Following stretching or necking, as the case may be, the nonwoven web is then creped. Creping can impart microfolds into the web to provide a variety of different characteristics thereto. For instance, creping can open the pore structure of the nonwoven web, thereby increasing its permeability. Moreover, creping can also enhance the stretchability of the web in the machine and/or cross-machine directions, as well as increase its softness and bulk. Various techniques for creping nonwoven webs are described in U.S. Pat. No. 6,197,404 to Varona which is incorporated by reference hereto in its entirety. For instance, FIG. 2 illustrates one embodiment of a creping process that can be used to crepe one (using generally the apparatus of 100) or both sides (using generally the apparatus of both 100 and 200) of a nonwoven web 20. The nonwoven web 20 may be passed through a first creping station 60, a second creping station 70, or both. If it is desired to crepe the nonwoven web 20 on only one side, it may be passed through either the first creping station 60 or the second creping station 70, with one creping station or the other being bypassed. If it is desired to crepe the nonwoven web 20 on both sides, it may be passed through both creping stations 60 and 70.

A first side 83 of the web 20 may be creped using the first creping station 60. The creping station 60 includes first a printing station having a lower patterned or smooth printing roller 62, an upper smooth anvil roller 64, and a printing bath 65, and also includes a dryer drum 66 and associated creping blade 68.

The rollers 62 and 64 nip the web 20 and guide it forward. As the rollers 62 and 64 turn, the patterned or smooth printing roller 62 dips into bath 65 containing an adhesive material, and applies the adhesive material to the first side 83 of the web 20 in a partial coverage at a plurality of spaced apart locations, or in a total coverage. The adhesive-coated web 20 is then passed around drying drum 66 whereupon the adhesive-coated surface 83 becomes adhered to the drum 66.

The first side 83 of the web 20 is then creped (i.e., lifted off the drum and bent) using doctor blade 68.

A second side 85 of the web 20 may be creped using the second creping station 70, regardless of whether or not the first creping station 60 has been bypassed. The second creping station 70 includes a second printing station including a lower patterned or smooth printing roller 72, an upper smooth anvil roller 74, and a printing bath 75, and also includes a dryer drum 76 and associated creping blade 78. The rollers 72 and 74 nip the web 20 and guide it forward. As the rollers 72 and 74 turn, the printing roller 72 dips into bath 75 containing adhesive material, and applies the adhesive to the second side 85 of the web 20 in a partial or total coverage. The adhesive-coated web 20 is then passed around drying drum 76 whereupon the adhesive-coated surface 85 becomes adhered to the surface of drum 76. The second side 85 of the web 20 is then creped using doctor blade 78. After creping, the nonwoven web 20 may be passed through a chilling station 80 and wound onto a storage roll 82 before being entangled.

The adhesive materials applied to the web 20 at the first and/or second printing stations may enhance the adherence of the substrate to the creping drum, as well as reinforce the fibers of the web 20. For instance, in some embodiments, the adhesive materials may bond the web to such an extent that the optional bonding techniques described above are not required.

A wide variety of adhesive materials may generally be utilized to reinforce the fibers of the web 20 at the locations of adhesive application, and to temporarily adhere the web 20 to the surface of the drums 66 and/or 76. Elastomeric adhesives (i.e., materials capable of at least 75% elongation without rupture) are especially suitable. Suitable materials include without limitation aqueous-based styrene butadiene adhesives, neoprene, polyvinyl chloride, vinyl copolymers, polyamides, ethylene vinyl terpolymers and combinations thereof. For instance, one adhesive material that can be utilized is an acrylic polymer emulsion sold by the B.F. Goodrich Company under the trade name HYCAR. In another example, such an adhesive may be an acrylic polymer such as Dur-o-set available from National Starch and Chemical. The adhesive may be applied using the printing technique described above or may, alternatively, be applied by meltblowing, melt spraying, dripping, splattering, or any other technique capable of forming a partial or total adhesive coverage on the nonwoven web 20.

The percent adhesive coverage of the web 20 can be selected to obtain varying levels of creping. For instance, the adhesive can cover between about 5% to 100% of the web surface, in some embodiments between about 10% to about 70% of the web surface, and in some embodiments, between about 25% to about 50% of the web surface. The adhesive can also penetrate the nonwoven web 20 in the locations where the adhesive is applied. In particular, the adhesive typically penetrates through about 10% to about 50% of the nonwoven web thickness, although there may be greater or less adhesive penetration at some locations.

Once the web is stretched (as in the necking process), the web 20 is then relatively dimensionally stabilized, first by the adhesive applied to the web 20, and second by the heat that is imparted during the creping process. This stabilization can set the cross directional stretch properties of the web 20. The machine direction stretch is further stabilized by the out-of-plane deformation of the bonded areas of the nonwoven web 20 that occurs during creping. Various techniques for creping nonwoven webs are described in U.S. Pat. No. 6,197,404 to Varona, which is incorporated by reference in its entirety.

In accordance with the present invention, the nonwoven web is then entangled using any of a variety of entanglement techniques known in the art (e.g., hydraulic, air, mechanical, etc.) The nonwoven web may be entangled either alone, or in conjunction with other materials. For example, in some embodiments, the nonwoven web is integrally entangled with a cellulosic fiber component using hydraulic entanglement. The cellulosic fiber component can generally comprise any desired amount of the resulting fabric. For example, in some embodiments, the cellulosic fiber component can comprise greater than about 50% by weight of the fabric, and in some embodiments, between about 60% to about 90% by weight of the fabric. Likewise, in some embodiments, the nonwoven web can comprise less than about 50% by weight of the fabric, and in some embodiments, from about 10% to about 40% by weight of the fabric.

When utilized, the cellulosic fiber component can contain cellulosic fibers (e.g., pulp, thermomechanical pulp, synthetic cellulosic fibers, modified cellulosic fibers, and the like), as well as other types of fibers (e.g., synthetic staple fibers). Some examples of suitable cellulosic fiber sources include virgin wood fibers, such as thermomechanical, bleached and unbleached softwood and hardwood pulps. Secondary or recycled fibers, such as obtained from office waste, newsprint, brown paper stock, paperboard scrap, etc., may also be used. Further, vegetable fibers, such as abaca, flax, milkweed, cotton, modified cotton, cotton linters, can also be used. In addition, synthetic cellulosic fibers such as, for example, rayon and viscose rayon may be used. Modified cellulosic fibers may also be used. For example, the fibrous material may be composed of derivatives of cellulose formed by substitution of appropriate radicals (e.g., carboxyl, alkyl, acetate, nitrate, etc.) for hydroxyl groups along the carbon chain.

When utilized, pulp fibers may have any high-average fiber length pulp, low-average fiber length pulp, or mixtures of the same. High-average fiber length pulp fibers typically have an average fiber length from about 1.5 mm to about 6 mm. Some examples of such fibers may include, but are not limited to, northern softwood, southern softwood, redwood, red cedar, hemlock, pine (e.g., southern pines), spruce (e.g., black spruce), combinations thereof, and the like. Exemplary high-average fiber length wood pulps include those available under the trade designation "Longlac 19".

The low-average fiber length pulp may be, for example, certain virgin hardwood pulps and secondary (i.e. recycled) fiber pulp from sources such as, for example, newsprint, reclaimed paperboard, and office waste. Hardwood fibers, such as eucalyptus, maple, birch, aspen, and the like, can also be used. Low-average fiber length pulp fibers typically have an average fiber length of less than about 1.2 mm, for example, from 0.7 mm to 1.2 mm. Mixtures of high-average fiber length and low-average fiber length pulps may contain a significant proportion of low-average fiber length pulps. For example, mixtures may contain more than about 50 percent by weight low-average fiber length pulp and less than about 50 percent by weight high-average fiber length pulp. One exemplary mixture contains 75% by weight low-average fiber length pulp and about 25% by weight high-average fiber length pulp.

As stated above, non-cellulosic fibers may also be utilized in the cellulosic fiber component. Some examples of suitable non-cellulosic fibers that can be used include, but are not limited to, polyolefin fibers, polyester fibers, nylon fibers, polyvinyl acetate fibers, and mixtures thereof. In some embodiments, the non-cellulosic fibers can be staple fibers having, for example, an average fiber length of between about 0.25 inches to about 0.375 inches. When non-cellulosic fibers are utilized, the cellulosic fiber component generally contains between about 80% to about 90% by weight cellulosic fibers, such as softwood pulp fibers, and between about 10% to about 20% by weight non-cellulosic fibers, such as polyester or polyolefin staple fibers.

Small amounts of wet-strength resins and/or resin binders may be added to the cellulosic fiber component to improve strength and abrasion resistance. Cross-linking agents and/or hydrating agents may also be added to the pulp mixture. Debonding agents may be added to the pulp mixture to reduce the degree of hydrogen bonding if a very open or loose nonwoven pulp fiber web is desired. The addition of certain debonding agents in the amount of, for example, about 1% to about 4% percent by weight of the fabric also appears to reduce the measured static and dynamic coefficients of friction and improve the abrasion resistance of the continuous filament rich side of the composite fabric. The debonding agent is believed to act as a lubricant or friction reducer.

Figure 3:
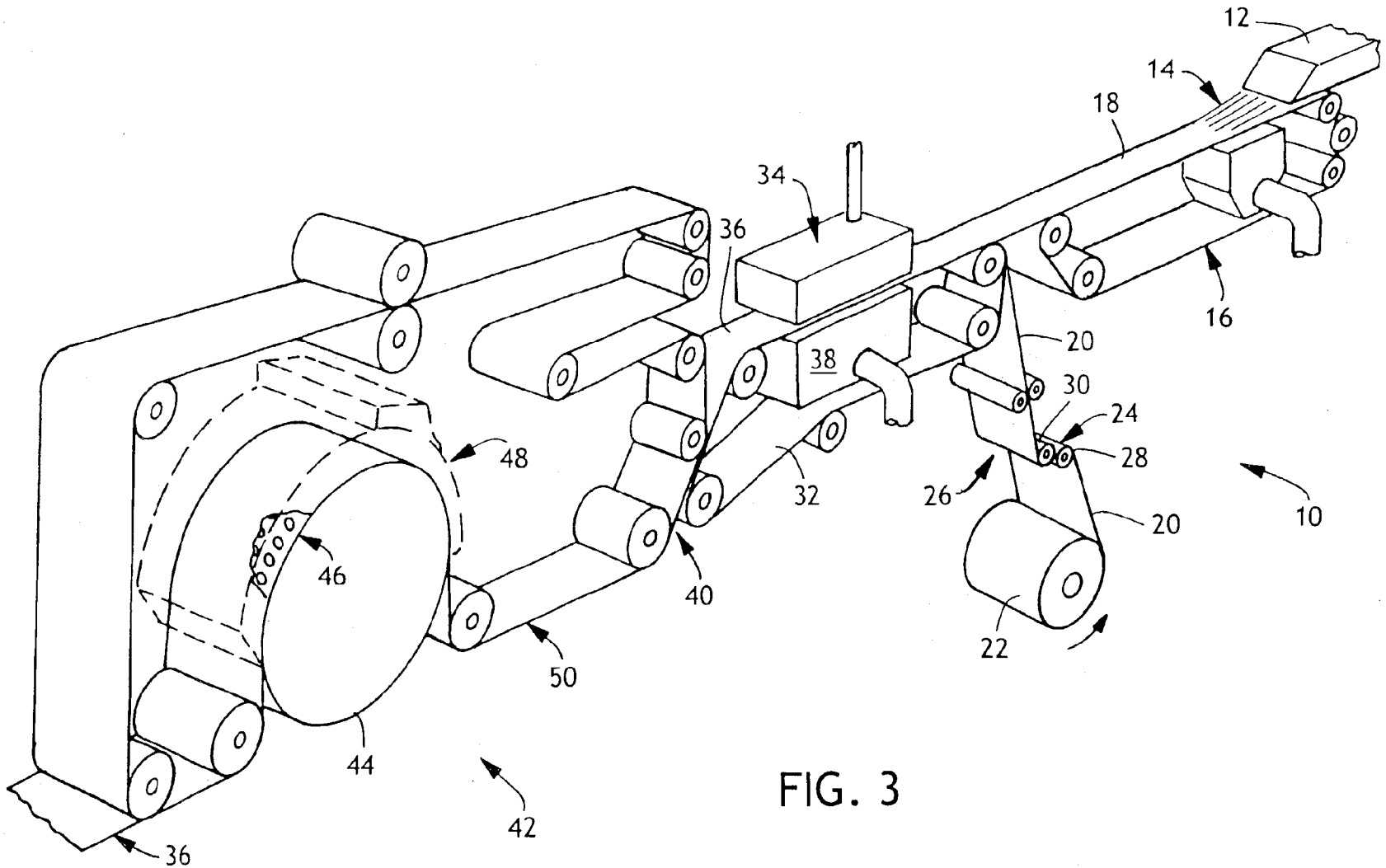
FIG. 3 is a schematic illustration of a process for forming a hydraulically entangled composite fabric in accordance with one embodiment of the present invention.

Referring to FIG. 3, one embodiment of the present invention for hydraulically entangling a cellulosic fiber component with a nonwoven web that contains monocomponent fibers is illustrated. As shown, a fibrous slurry containing cellulosic fibers is conveyed to a conventional papermaking headbox 12 where it is deposited via a sluice 14 onto a conventional forming fabric or surface 16. The suspension of fibrous material may have any consistency that is typically used in conventional papermaking processes. For example, the suspension may contain from about 0.01 to about 1.5 percent by weight fibrous material suspended in water. Water is then removed from the suspension of fibrous material by a vacuum box to form a uniform layer of the fibrous material 18.

The nonwoven web 20 is also unwound from a supply roll 22 and travels in the direction indicated by the arrow associated therewith as the supply roll 22 rotates in the direction of the arrows associated therewith. The nonwoven web 20 passes through a nip 24 of an S-roll arrangement 26 formed by the stack rollers 28 and 30. The nonwoven web 20 is then placed upon a foraminous entangling surface 32 of a conventional hydraulic entangling machine where the cellulosic fibrous layer 18 is then laid on the web 20. Although not required, it is typically desired that the cellulosic fibrous layer 18 be between the nonwoven web 20 and the hydraulic entangling manifolds 34. The cellulosic fibrous layer 18 and nonwoven web 20 pass under one or more hydraulic entangling manifolds 34 and are treated with jets of fluid to entangle the cellulosic fibrous material with the fibers of the nonwoven web 20. The jets of fluid also drive cellulosic fibers into and through the nonwoven web 20 to form the composite fabric 36.

Alternatively, hydraulic entangling may take place while the cellulosic fibrous layer 18 and nonwoven web 20 are on the same foraminous screen (e.g., mesh fabric) that the wet-laying took place. The present invention also contemplates superposing a dried cellulosic fibrous sheet on a nonwoven web, rehydrating the dried sheet to a specified consistency and then subjecting the rehydrated sheet to hydraulic entangling. The hydraulic entangling may take place while the cellulosic fibrous layer 18 is highly saturated with water. For example, the cellulosic fibrous layer 18 may contain up to about 90% by weight water just before hydraulic entangling. Alternatively, the cellulosic fibrous layer 18 may be an air-laid or dry-laid layer.

Hydraulic entangling may be accomplished utilizing conventional hydraulic entangling equipment such as described in, for example, in U.S. Pat. No. 3,485,706 to Evans, which is incorporated herein in its entirety by reference thereto for all purposes. Hydraulic entangling may be carried out with any appropriate working fluid such as, for example, water. The working fluid flows through a manifold that evenly distributes the fluid to a series of individual holes or orifices. These holes or orifices may be from about 0.003 to about 0.015 inch in diameter and may be arranged in one or more rows with any number of orifices, e.g., 30–100 per inch, in each row. For example, a manifold produced by Honeycomb Systems Incorporated of Biddeford, Me., containing a strip having 0.007-inch diameter orifices, 30 holes per inch, and 1 row of holes may be utilized. However, it should also be understood that many other manifold configurations and combinations may be used. For example, a single manifold may be used or several manifolds may be arranged in succession.

Fluid can impact the cellulosic fibrous layer 18 and the nonwoven web 20, which are supported by a foraminous surface, such as a single plane mesh having a mesh size of from about 40×40 to about 100×100. The foraminous surface may also be a multi-ply mesh having a mesh size from about 50×50 to about 200×200. As is typical in many water jet treatment processes, vacuum slots 38 may be located directly beneath the hydro-needling manifolds or beneath the foraminous entangling surface 32 downstream of the entangling manifold so that excess water is withdrawn from the hydraulically entangled composite material 36.

Although not held to any particular theory of operation, it is believed that the columnar jets of working fluid that directly impact cellulosic fibers 18 laying on the nonwoven web 20 work to drive those fibers into and partially through the matrix or network of fibers in the web 20. When the fluid jets and cellulosic fibers 18 interact with a nonwoven web 20, the cellulosic fibers 18 are also entangled with fibers of the nonwoven web 20 and with each other. To achieve the desired entangling of the fibers, it is typically desired that hydroentangling be performed using water pressures from about 1000 to 3000 psig, and in some embodiments from about 1200 to 1800 psig. When processed at the upper ranges of the described pressures, the composite fabric 36 may be processed at speeds of up to about 1000 feet per minute (fpm).

As indicated above, the pressure of the jets in the entangling process is typically at least about 1000 psig because lower pressures often do not generate the desired degree of entanglement. However, it should be understood that adequate entanglement may be achieved at substantially lower water pressures, particularly with lighter basis weight materials. In addition, greater entanglement may be achieved, in part, by subjecting the fibers to the entangling process two or more times. Thus, it may be desirable that the web be subjected to at least one run under the entangling apparatus, wherein the water jets are directed to the first side and an additional run wherein the water jets are directed to the opposite side of the web.

After the fluid jet treatment, the resulting composite fabric 36 may then be transferred to a non-compressive drying operation. A differential speed pickup roll 40 may be used to transfer the material from the hydraulic needling belt to a non-compressive drying operation. Alternatively, conventional vacuum-type pickups and transfer fabrics may be used. If desired, the composite fabric 36 may be wet-creped before being transferred to the drying operation. Non-compressive drying of the fabric 36 may be accomplished utilizing a conventional rotary drum through-air drying apparatus 42. The through-dryer 42 may be an outer rotatable cylinder 44 with perforations 46 in combination with an outer hood 48 for receiving hot air blown through the perforations 46. A through-dryer belt 50 carries the composite fabric 36 over the upper portion of the through-dryer outer cylinder 40. The heated air forced through the perforations 46 in the outer cylinder 44 of the through-dryer 42 removes water from the composite fabric 36. The temperature of the air forced through the composite fabric 36 by the through-dryer 42 may range from about 200° F. to about 500° F. Other useful through-drying methods and apparatus may be found in, for example, U.S. Pat. No. 2,666,369 to Niks and U.S. Pat. No. 3,821,068 to Shaw, which are incorporated herein in their entirety by reference thereto for all purposes.

It may also be desirable to use finishing steps and/or post treatment processes to impart selected properties to the composite fabric 36. For example, the fabric 36 may be lightly pressed by calender rolls, creped, brushed or otherwise treated to enhance stretch and/or to provide a uniform exterior appearance and/or certain tactile properties. Alternatively or additionally, various chemical post-treatments, such as, adhesives or dyes, may be added to the fabric 36. Additional post-treatments that can be utilized are described in U.S. Pat. No. 5,853,859 to Levy, et al. which is incorporated herein in its entirety by reference thereto for all purposes. Multiple creping processes are described in U.S. Pat. No. 3,879,257 and U.S. Pat. No. 6,325,864 B2 to Anderson et al. which is incorporated herein in its entirety by reference thereto for all purposes.

The basis weight of the fabric of the present invention can generally range from about 20 to about 200 grams per square meter (gsm), and particularly from about 50 gsm to about 150 gsm. Lower basis weight products are typically well suited for use as light duty wipers, while the higher basis weight products are better adapted for use as industrial wipers.

As a result of the present invention, it has been discovered that a fabric may be formed having a variety of beneficial characteristics. For example, by utilizing a nonwoven web component that is formed from monocomponent spunbond fibers that have been necked, creped and entangled, the resulting fabric may be softer and possess enhanced conformability properties. Further, the resulting fabric may demonstrate enhanced oil absorption properties.

The present invention may be better understood with reference to the following examples.

EXAMPLE 1

The ability to form an entangled fabric in accordance with the present invention was demonstrated. Initially, a 0.3 osy point bonded, spunbond web was formed, using a process as generally described in Matsuki U.S. Pat. No. 3,802,817. The spunbond web contained 100% polypropylene fibers. The polypropylene fibers had a denier per filament of approximately 2.5. The bond pattern was wire weave, as described above and bonded at about 295° F. The spunbond web was then necked using a process as described under the following parameters. The percent draw was about 20 percent (that is the second roll set is traveling about 20 percent faster than the first roll set). Necking was done without heat. The web was necked 60%, that is the web was necked (narrowed) in the width to about 60% of its prenecked width, which equated to approximately 120 percent CD stretch in the web. The basis weight was then about 0.8 osy. The necked spunbond was then creped 60%. The creping adhesive used was a National Starch and Chemical latex adhesive Dur-o-set E-200 which was applied to the sheet using a gravure printer. The creping drum was maintained at 190 degrees F.

The spunbond web was then hydraulically entangled on a coarse wire using three jet strips with a pulp fiber component at an entangling pressure of 1200 pounds per square inch. The pulp fiber component contained Terance Bay LL-19 northern softwood kraft fibers (Kimberly-Clark) and 1 wt. % of Arosurf® PA801 (an imidazoline debonder available from Goldschmidt). The pulp fiber component of the sample also contained 2 wt. % of polyethylene glycol 600. The fabric was dried and print bonded to a dryer using an ethylene/vinyl acetate copolymer latex adhesive available from Air Products, Inc. under the name "Airflex A-105" (viscosity of 95 cps and 28% solids). The fabric was then creped using a degree of creping of 20%. The resulting fabric had a basis weight of about 125 grams per square meter, and contained 20% by weight of the nonwoven web and 80% of the pulp fiber component.

Test Methods for Additional Examples:

Oil Absorption Efficiency

Viscous Oil Absorption is a method used to determine the ability of a fabric to wipe viscous oils. A sample of the web (preweighed) is first mounted on a padded surface of a sled (10 cm×6.3 cm). The sled is mounted on an arm designed to traverse the sled across a rotating disk. The sled is then weighted so that the combined weight of the sled and sample is about 768 grams. Thereafter, the sled and traverse arm are positioned on a horizontal rotatable disc with the sample being pressed against the surface of the disc by the weighted sled. Specifically, the sled and traverse arm are positioned with the leading edge of the sled (6.3 cm side) just off the center of the disc and with the 10 cm centerline of the sled being positioned along a radial line of the disc so that the trailing 6.3 cm edge is positioned near the perimeter of the disc.

One (1) gram of an oil is then placed on the center of the disc in front of the leading edge of the sled. The disc, which has a diameter of about 60 centimeters, is rotated at about 65 rpm while the traverse arm moves the sled across the disc at a speed of about 2½ centimeters per second until the trailing edge of the sled crosses off the outer edge of the disc. At this point, the test is stopped. The wiping efficiency is evaluated by measuring the change in weight of the wiper before and after the wiping test. The fractional wiping efficiency is determined as a percentage by dividing the increase in weight of the wiper by one (1) gram (the total oil weight), and multiplying by 100. The test described above is performed under constant temperature and relative humidity conditions (70° F.±2° F. and 65% relative humidity).

Web Oil Permeability

Web permeability is obtained from a measurement of the resistance by the material to the flow of liquid. A liquid of known viscosity is forced through the material of a given thickness at a constant flow rate and the resistance to flow, measured as a pressure drop is monitored. Darcy's Law is used to determine permeability as follows:

$$\text{Permeability}=[\text{flow rate}\times\text{thickness}\times\text{viscosity}/\text{pressure drop}]$$

where the units are as follows:

| | |
|---|---|
| permeability: | $cm^2$ or darcy (1 darcy = 9.87 × 10−9 $cm^2$) |
| flow rate: | cm/sec |
| viscosity: | pascal-sec |
| pressure drop: | pascals |

The apparatus includes an arrangement wherein a piston within a cylinder pushes liquid through the sample to be measured. The sample is clamped between two aluminum cylinders with the cylinders oriented vertically. Both cylinders have an outside diameter of 3.5", an inside diameter of 2.5" and a length of about 6". The 3" diameter web sample is held in place by its outer edges and hence is completely contained within the apparatus. The bottom cylinder has a piston that is capable of moving vertically within the cylinder at a constant velocity and is connected to a pressure transducer that capable of monitoring the pressure encountered by a column of liquid supported by the piston. The transducer is positioned to travel with the piston such that there is no additional pressure measured until the liquid column contacts the sample and is pushed through it. At this point, the additional pressure measured is due to the resistance of the material to liquid flow through it. The piston is moved by a slide assembly that is driven by a stepper motor.

The test starts by moving the piston at a constant velocity until the liquid is pushed through the sample. The piston is then halted and the baseline pressure is noted. This corrects for sample buoyancy effects. The movement is then resumed for a time adequate to measure the new pressure. The difference between the two pressures is the pressure due to the resistance of the material to liquid flow and is the pressure drop used in the Equation set forth above. The velocity of the piston is the flow rate. Any liquid whose viscosity is known can be used, although a liquid that wets the material is preferred since this ensures that saturated flow is achieved. The measurements were carried out using a piston velocity of 20 cm/min, mineral oil (Peneteck Technical Mineral Oil manufactured by Penreco of Los Angeles, Calif.) of a viscosity of 6 centipoise. This method is also described in U.S. Pat. No. 6,197,404 to Varona, et al.

Drape Stiffness

The "drape stiffness" test measures the resistance to bending of a material. The bending length is a measure of the interaction between the material weight and stiffness as shown by the way in which the material bends under its own weight, in other words, by employing the principle of cantilever bending of the composite under its own weight. In general, the sample was slid at 4.75 inches per minute (12 cm/min), in a direction parallel to its long dimension, so that its leading edge projected from the edge of a horizontal surface. The length of the overhang was measured when the tip of the sample was depressed under its own weight to the point where the line joining the tip to the edge of the platform made a 41.50° angle with the horizontal. The longer the overhang, the slower the sample was to bend; thus, higher numbers indicate stiffer composites. This method conforms to specifications of ASTM Standard Test D 1388. The drape stiffness, measured in inches, is one-half of the length of the overhang of the specimen when it reaches the 41.50° slope.

The test samples were prepared as follows. Samples were cut into rectangular strips measuring 1 inch (2.54 cm) wide and 6 inches (15.24 cm) long. Specimens of each sample were tested in the machine direction and cross direction. A suitable Drape-Flex Stiffness Tester, such as FRL-Cantilever Bending Tester, Model 79-10 available from Testing Machines Inc., located in Amityville, N.Y., was used to perform the test.

Oil Absorbency Rate

The absorbency rate of oil is the time required, in seconds, for a sample to absorb a specified amount of oil. For example, the absorbency of 80W-90 gear oil was determined in the example as follows. A plate with a three-inch diameter opening was positioned on the top of a beaker. The sample was draped over the top of the beaker and covered with the plate to hold the specimen in place. A calibrated dropper was filled with oil and held above the sample. Four drops of oil were then dispensed from the dropper onto the sample, and a timer was started. After the oil was absorbed onto the sample and was no longer visible in the three-inch diameter opening, the timer was stopped and the time recorded. A lower absorption time, as measured in seconds, was an indication of a faster intake rate. The test was run at conditions of 73.4°±3.6° F. and 50%±5% relative humidity.

Oil Cleaning Efficiency/Oil Wiping Efficiency:

For viscous oil absorbance, the following test was run. The test involves wipe-dry equipment. One gram of 1700 viscosity gear oil is administered to the center of an instrument turntable. A weighed wiper sample traverses the turntable in 10 seconds, the wiper sample is removed and reweighed. The percent oil picked up determines the viscous oil wiping/cleaning efficiency.

Grease Wiping/Gardner Wiping Efficiency Test:

One gram of Moly-graph multipurpose grease was spread with a Gardner 5 mil coating bar over a 3"×8" tile. Essentially, grease is spread in a weighed amount with the bar on the tile to make a uniform film on the tile. A weighed wiper is then mounted on a sled (rough side out) and subjected to 10 cycles of wiping the grease via a back and forth motion against the tile, in the length direction of the tile. The sled moves between 6 and 8 inches to traverse the tile. The wiper is then weighed to determine the grease accumulated on the wiper. The grease wiping efficiency is then determined as a percentage, of total grease removed by the wiper on a weight basis.

The following samples were also prepared and were compared with standard/control wipers of ShopPro available from Kimberly-Clark Corporation. ShopPro is a spunbond/pulp wiper, of 125 gsm with NWSK LL19 pulp of about 80% of the wiper. In some instances, where noted the control included PEG as previously described.

TABLE 1

| Sample Number | Sample Type | Conditions/Other Descriptors |
|---|---|---|
| 1 | Control with PEG | Polypropylene SB 0.8 osy and LL-19 @ 125 gsm |
| 2 | Necked, Creped Polypropylene SB | 60% necked<br>60% creped<br>112–125 gsm at 700, 1000 and 1200 psi jet pressure |

Note that "PP" represents polypropylene and "SB" represents spunbond.

Sample number 2 was very flexible and stretchy. The sample also demonstrated the best grease wiping performance. The stretch of a control spunbond wiper demonstrated a 40 percent elongation at break in the MD direction and between a 70 and 80% elongation at break in the CD direction. In comparison, the creped, necked spunbond demonstrated almost an 80% elongation at break in the MD direction and a 120% elongation at break in the CD direction. The necked, creped spunbond sample also demonstrated an oil permeability of approximately 100 darcies, compared to between 60–70 darcies for certain standard spunbond control samples. The necked, creped, spunbond also demonstrated grease wiping efficiency of approximately 85% compared with a value of approximately 50% for a control. The effect of the nonwoven on viscous oil absorption was also higher for necked and creped spunbond, which demonstrated a percent oil absorption, oil wipe dry of approximately 82–83, compared with the 62–70 value for the standard spunbond. Finally, when comparing absorbency rates for 0.1 ml, (126 gsm) the performance rates for the necked, creped material compared to the standard spunbond of the ShopPro was as follows.

TABLE 2

| Sample | Smooth side | Rough side |
|---|---|---|
| ShopPro Control | 45 sec | 53 sec |
| Necked, creped SB wiper | 28 sec | 22 sec |

Further, the samples demonstrated the following comparative summarized testing values.

TABLE 3

| Sample | Basis Weight (gsm) | MD Drape inches overhang (stiffness) | CD Drape inches overhang (stiffness) | Oil Wipe Dry (percent) | Web Oil Permeability (darcies) | Grease Cln. (percent) |
|---|---|---|---|---|---|---|
| ShopPro Control | 150 | 3 | 2.85 | 62 | 70.5 | 50 |
| Control + PEG | 126 | 3.3 | 2.55 | 70 | 66 | 62 |
| Neck/Creped/Sample | 121 | 2.85 | 1.95 | 82 | 102 | 86 |

It therefore is seen that the necking and creping of the spunbond material prior to hydroentangling provides softness and stretch for conformability. Further, due to the high pore volume created in the necked and creped spunbond, the wiper has high viscous oil and grease absorption.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for forming a fabric comprising:

necking a spunbond web of monocomponent thermoplastic fibers, said spunbond web defining a first surface and a second surface;

creping at least one surface of said spunbond web; and thereafter, hydraulically entangling said spunbond web with a fibrous component that contains cellulosic fibers, wherein said fibrous component comprises greater than about 50% by weight of the fabric.

2. A method as defined in claim 1, further comprising adhering said first surface of said spunbond web to a first creping surface and creping said web from said first creping surface.

3. A method as defined in claim 2, further comprising applying a creping adhesive to said first surface of said spunbond web in a spaced-apart pattern such that said first surface is adhered to said creping surface according to said spaced-apart pattern.

4. A method as defined in claim 3, further comprising adhering said second surface of said spunbond web to a second creping surface and creping said web from said second surface.

5. A method as defined in claim 4, further comprising applying a creping adhesive to said second surface of said spunbond web in a spaced-apart pattern such that said second surface is adhered to said creping surface according to said spaced-apart pattern.

6. A method as defined in claim 1, wherein said thermoplastic fibers are polyolefin and have a denier per filament of less than about 3.

7. A method as defined in claim 1, further comprising point bonding said spunbond web.

8. A method as defined in claim 1, wherein said fibrous component comprises from about 60% to about 90% by weight of the fabric.

9. A wiper made in accordance with the method of claim 1.

* * * * *